US009671153B2

(12) United States Patent
Hagiwara et al.

(10) Patent No.: US 9,671,153 B2
(45) Date of Patent: Jun. 6, 2017

(54) LOW-TEMPERATURE STORAGE

(75) Inventors: Atsushi Hagiwara, Gunma-ken (JP); Ryuichi Tsuruma, Gunma-ken (JP); Yuichi Tamaoki, Gunma-ken (JP)

(73) Assignee: PANASONIC HEALTHCARE HOLDINGS CO., LTD., Tokyo (JP)

( * ) Notice: Subject to any disclaimer, the term of this patent is extended or adjusted under 35 U.S.C. 154(b) by 1001 days.

(21) Appl. No.: 13/536,339

(22) Filed: Jun. 28, 2012

(65) Prior Publication Data

US 2013/0000331 A1 Jan. 3, 2013

Related U.S. Application Data

(63) Continuation of application No. PCT/JP2010/073362, filed on Dec. 24, 2010.

(30) Foreign Application Priority Data

Dec. 28, 2009 (JP) ..... 2009-297748

(51) Int. Cl.
*F25B 49/00* (2006.01)
*F25D 23/02* (2006.01)

(52) U.S. Cl.
CPC ..... *F25D 23/025* (2013.01); *F25D 2400/361* (2013.01); *F25D 2600/02* (2013.01); *F25D 2700/02* (2013.01); *F25D 2700/12* (2013.01)

(58) Field of Classification Search
CPC ..... F25B 49/00; F25B 2600/024; F25B 2700/2104

(Continued)

(56) References Cited

U.S. PATENT DOCUMENTS 5,224,355 A 7/1993 So et al.
5,524,447 A * 6/1996 Shim ..... F25D 17/045 236/91 R (Continued)

FOREIGN PATENT DOCUMENTS

JP 58-217174 A 12/1983
JP 5-149657 A 6/1993

(Continued)

OTHER PUBLICATIONS

International Search Report issued in corresponding International Application No. PCT/JP2010/073362 dated Mar. 22, 2011 and English translation thereof (7 pages).

(Continued)

*Primary Examiner* — Justin Jonaitis
*Assistant Examiner* — Larry Furdge
(74) *Attorney, Agent, or Firm* — McDermott Will & Emery LLP

(57) ABSTRACT

A low-temperature storage includes: a thermally-insulating casing including an accommodating portion accommodating an item to be refrigerated; a door to be closed in a manner capable of opening/closing the portion; a cooling mechanism cooling an interior thereof; a temperature-detecting unit measuring a temperature in the portion; an opening/closing-detecting unit detecting a door open/close state; and a control unit including a temperature-adjusting unit controlling the cooling mechanism so that the temperature reaches a target temperature, first- and second-temperature-storing units storing first and second temperatures, respectively, a target-temperature-setting unit setting the target temperature at the first temperature when the opening/closing-detecting unit detects that the door has changed from an open to closed state, and thereafter, setting the target temperature at the second temperature, and a control-infor- (Continued)

mation-setting unit setting the first or second temperatures, and when a difference therebetween is equal to or greater than a predetermined value, outputting information indicating as such.

1 Claim, 8 Drawing Sheets

(58) Field of Classification Search
USPC ..... 62/131
See application file for complete search history.

(56) References Cited

U.S. PATENT DOCUMENTS

| | | | | |
|---|---|---|---|---|
| 6,722,142 | B1 * | 4/2004 | Pagel | 62/131 |
| 2009/0165496 | A1 * | 7/2009 | Zhang et al. | 62/498 |

FOREIGN PATENT DOCUMENTS

| | | | |
|---|---|---|---|
| JP | 5-322415 | A | 12/1993 |
| JP | 2005-156104 | A | 6/2005 |
| JP | 2005-539313 | A | 12/2005 |
| JP | 2008-045790 | A | 2/2008 |

OTHER PUBLICATIONS

Japanese Office Action issued in corresponding Japanese Application No. 2100-547651, dated Sep. 24, 2013.
Extended European Search Report issued in corresponding European Patent Application No. EP10840953.3, dated Jul. 26, 2016 (10 pgs.).

* cited by examiner

LOW-TEMPERATURE STORAGE

CROSS-REFERENCE TO RELATED APPLICATION

This application claims the benefit of priority to Japanese Patent Application No. 2009-297748, filed Dec. 28, 2009, of which full contents are incorporated herein by reference.

BACKGROUND OF THE INVENTION

Field of the Invention

The present invention relates to a low-temperature storage, and more particularly to a technique of reducing power consumption while maintaining quality of preservation of an item to be refrigerated.

Description of the Related Art

Japanese Patent Application Laid-Open Publication No. 2008-45790 discloses a low-temperature storage that includes a refrigerant circuit, a main body configured with a thermally insulated casing, a storage chamber to be cooled by a cooling device, and a blower for circulating cold air, wherein the blower is operated to forcibly circulate cold air, cooled by the endothermic action of a cooler, in the storage chamber, thereby cooling the interior of the storage chamber to a predetermined temperature. In Japanese Patent Application Laid-Open Publication No. 5-322415, a partition wall is provided on the cold air intake side of the cold-air circulation blower so as to partition a chamber into that on the storage chamber and that on the cold air intake side, a temperature sensor for detecting the internal temperature is provided in a space formed by the partition wall, and based on this, an internal temperature is displayed.

In a low-temperature storage such as a refrigerator, a freezer, an increase in set temperature leads to a reduction in load on a refrigerating machine (e.g., reduction in load on a compression machine (compressor)), thereby being able to reduce power consumption. However, in order to maintain the quality of preservation of the item to be refrigerated, practically, there is a tendency to set the set temperature at a temperature lower than that actually required, allowing an increase in the internal temperature when the door is opened/closed. In particular, when the item to be refrigerated is a medical product, a biological sample, etc., it is often the case that opening/closing for taking out the item to be refrigerated and opening/closing for returning the item to be refrigerated into the device are performed at short intervals, such as right after the door is opened and closed to take out a container storing the above items, the door is opened and closed to return the container into the device. In such use environment, particularly, the necessity to maintain the quality of preservation is great, resulting in a tendency to set the set temperature lower.

Whereas, it is normal that the frequency of opening/closing of the door varies with the time of day, or from day to day. For example, in a household refrigerator which is used to refrigerate food and the like, the frequency of opening/closing of the door during the evening hours is low as compared with that during the daytime hours. The door opening/closing frequency of a low-temperature storage provided in a research facility or healthcare facility which is used to refrigerate a medical product, a biological sample, or the like is extremely decreased on holidays and during a long vacation as compared to weekdays. Thus, when the set temperature is set lower so as to maintain the quality of preservation of the item to be refrigerated, the internal temperature is unnecessarily maintained at a low temperature even during a period of low frequency of opening/closing, thereby needlessly consuming power.

SUMMARY OF THE INVENTION

A low-temperature storage according to an aspect of the present invention, includes: a thermally insulated casing including an accommodating portion insulated from external air, the accommodating portion configured to accommodate an item to be refrigerated; a door provided on the thermally insulated casing, the door configured to be closed in such a manner as to be capable of opening/closing the accommodating portion; a cooling mechanism configured to cool an interior of the accommodating portion; a temperature detecting unit configured to measure a temperature in the accommodating portion; an opening/closing detecting unit configured to detect an open/closed state of the door; and a control unit, the control unit including a temperature adjusting unit configured to control the cooling mechanism so that a temperature measured by the temperature detecting unit becomes equal to a predetermined target temperature, a first temperature storing unit configured to store a first temperature, a second temperature storing unit configured to store a second temperature higher than the first temperature, a target temperature setting unit configured to set the target temperature at the first temperature when the opening/closing detecting unit detects that the door has been changed from an open state to closed state, and thereafter, set the target temperature at the second temperature, and a control information setting unit configured to arbitrarily set the first temperature stored in the first temperature storing unit or the second temperature stored in the second temperature storing unit, the control information setting unit further configured to, when a difference between the accepted first and second temperatures is equal to or greater than a predetermined value, output information indicating that the difference between the accepted first and second temperatures is equal to or greater than the predetermined value.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Figure 1:
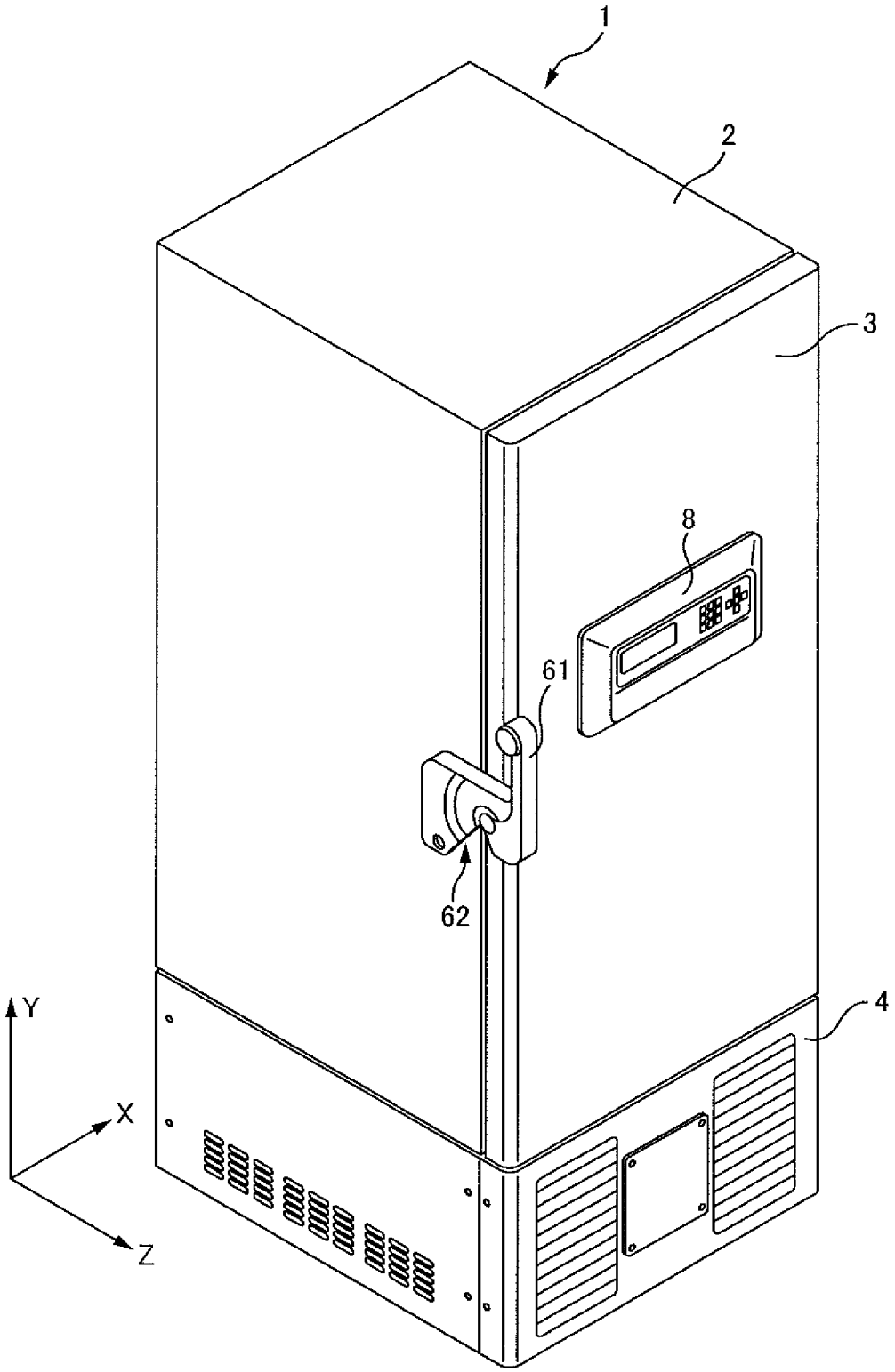
FIG. 1 is a perspective view illustrating a low-temperature storage 1 according to an embodiment of the present invention.

Hereinafter, a description will be given of an embodiment for implementing the invention. FIG. 1 is a perspective view of a low-temperature storage 1 for describing an embodiment of the embodiment. The X axis depicted in the figure is a left-and-right direction with respect to the low-temperature storage 1, the Y axis is an up-and-down direction with respect to the low-temperature storage 1, and the Z axis is a front-and-back direction with respect to the low-temperature storage 1.

The low-temperature storage 1 illustrated in the figure, for example, is a refrigerator or freezer provided in a research facility or healthcare facility to refrigerate and store medical product, a biological sample (specimen), or the like. As illustrated in the figure, the low-temperature storage 1 includes: a thermally insulated casing 2; a door 3 provided on the front surface of the thermally insulated casing 2; and a machine compartment 4 provided on a lower portion (−Y direction) of the thermally insulated casing 2.

Figure 2:
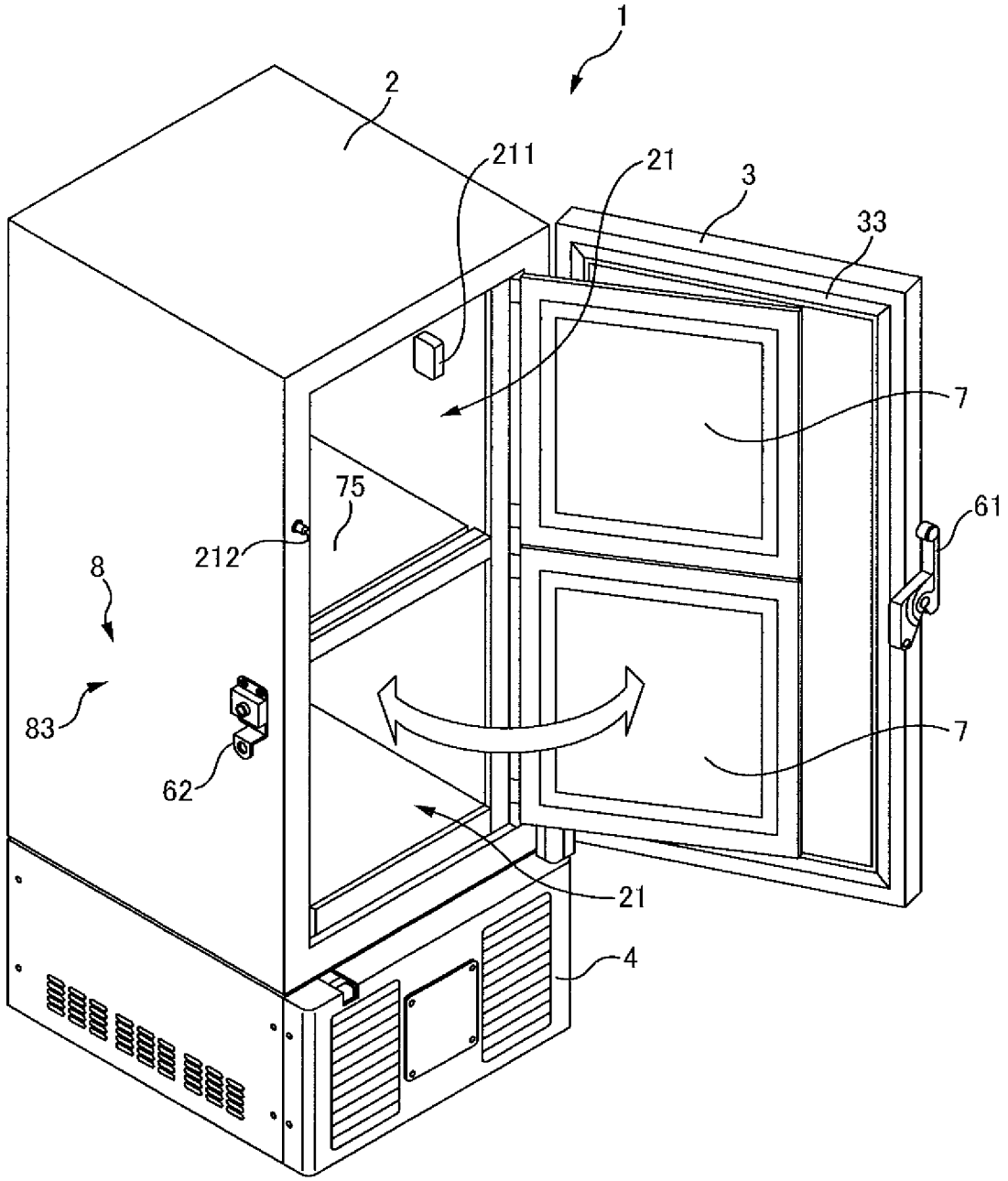
FIG. 2 is a perspective view illustrating a low-temperature storage 1 with a door 3 being in an open state.

FIG. 2 is a perspective view illustrating the low-temperature storage 1 with the door 3 being in an open state. As illustrated in the figure, in an interior of the thermally insulated casing 2, an accommodating portion 21 is provided which accommodates an item to be refrigerated and is insulated from the exterior. The front surface (+Z side) of the thermally insulated casing 2 is open. The door 3 is provided on the front surface side (+Z side) of the thermally insulated casing 2 through a connecting mechanism such as a hinging mechanism in order to close the opening in such a manner as to be capable of being opened and closed.

On the left end side of the door 3 in the −X direction, a lever 61 is provided that is gripped when the door 3 is opened/closed. In proximity to the front +Z end on the −X side face of the thermally insulated casing 2, an engagement part 62 is provided at a position at which the lever 61 is engaged therein when the door 3 is in a closed state.

The interior of the door 3 is filled with a foam insulation material. In the peripheral edge portion on the accommodating portion 21 (−Z side) side of the door 3, packing 33 is provided to maintain air-tightness of the accommodating portion 21. An inner door 7 is provided on the accommodating portion 21 (−Z side) side of the door 3. The accommodating portion 21 is provided with a partitioning plate 75 for vertically partitioning the internal space.

A part of a cooling mechanism 71 configured to cool the accommodating portion 21 is accommodated in the machine compartment 4. The cooling mechanism 71 includes a cooling coil, a compressor, a condenser, a liquid receiver, an expansion valve, and an evaporator; and the cooling coil, the compressor, the condenser, the liquid receiver, and the expansion valve are provided in the machine compartment 4. On the other hand, the evaporator is provided along the external surface of an inner case between an outer case and the inner case of the thermally insulated casing 2 to execute heat exchange between a refrigerant and the accommodating portion 21. During the operation of the cooling mechanism 71, the refrigerant is circulated in the compressor, the condenser, a pressure reducer, the evaporator and piping connecting these components. The cooling mechanism 71 is not always limited to the above configuration. For example, another method may be used such as a multistage compression refrigeration apparatus or the like.

As illustrated in FIG. 1, in the front surface (+Z side) of the door 3, a control panel 8 is provided for interactive processing with a user. The user can set a temperature, etc., and monitor the operating state of the cooling mechanism 71 through the control panel 8.

As illustrated in FIG. 2, at a predetermined position on an inner wall of the accommodating portion 21, a temperature sensor 211 (temperature detection unit) is provided to detect the temperature of the accommodating portion 21. Further, on the edge part, configured to abut on the door 3, on the open surface side (+Z side) of the thermally insulated casing 2, an opening/closing sensor 212 (opening/closing detection part) is provided to detect the open/closed state of the door 3. The opening/closing sensor 212 is configured using a mechanical switch or a non-contact switch.

The control of user interface through the control panel 8 and/or the operational control of the cooling mechanism 71 or is executed by the control unit 30 provided in the low-temperature storage 1. The control unit 30 is installed on the back surface or the interior of the control panel 8, or in the machine compartment 4, the thermally insulated casing 2, the door 3, or the like, for example.

Figure 3A:
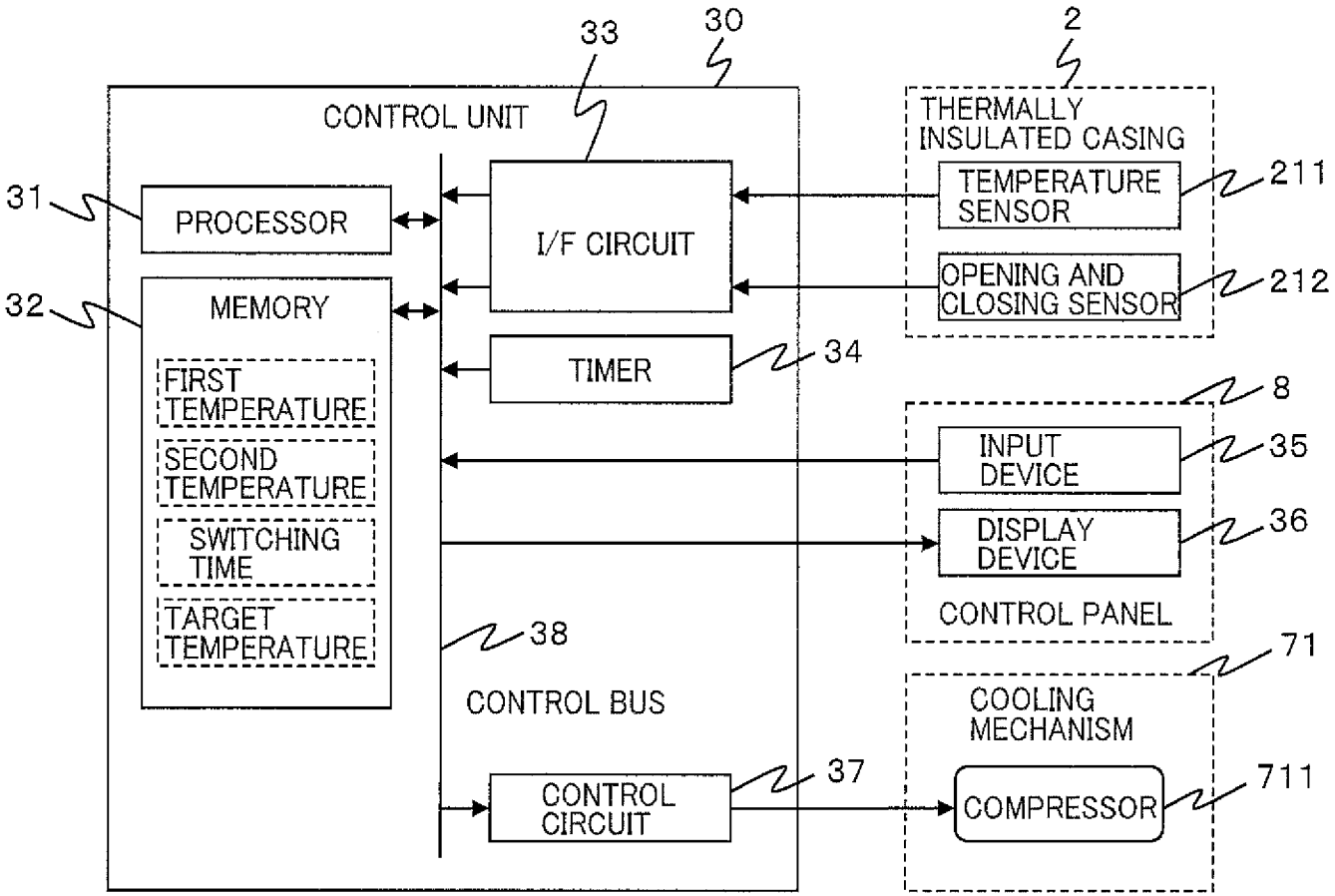
FIG. 3A is a diagram illustrating a hardware configuration of a control unit 30.

The hardware configuration of the control unit 30 is illustrated in FIG. 3A. As illustrated in the figure, the control unit 30 includes a processor 31, a memory 32, an I/F circuit 33, a timer 34, and a control circuit 37. The constituent elements and an input device 35 and a display device 36 configuring the control panel 8 are connected to enable mutual communication through a control bus 38.

The processor 31 is configured with a central processing unit (CPU), a micro processing unit (MPU), etc. The memory 32 (first temperature storage unit, second temperature storage unit, switching time storage unit) is configured using a random access memory (RAM), a read only memory (ROM), a non-volatile RAM (NVRAM), etc. Programs and data are stored in the memory 32.

The timer 34 is configured with a real time clock (RTC), etc., and is configured to output information related to time, such as the current time or the measured time, in response to a request from the processor 31, etc. The input device 35 is a key board or touch panel, for example. For example, the display device 36 is a liquid crystal panel.

The I/F circuit 33 amplifies and/or A/D converts an analog signal inputted from the opening/closing sensor 212 and the temperature sensor 211, and inputs a digital signal corresponding to the analog signal to the bus 38.

Figure 3B:
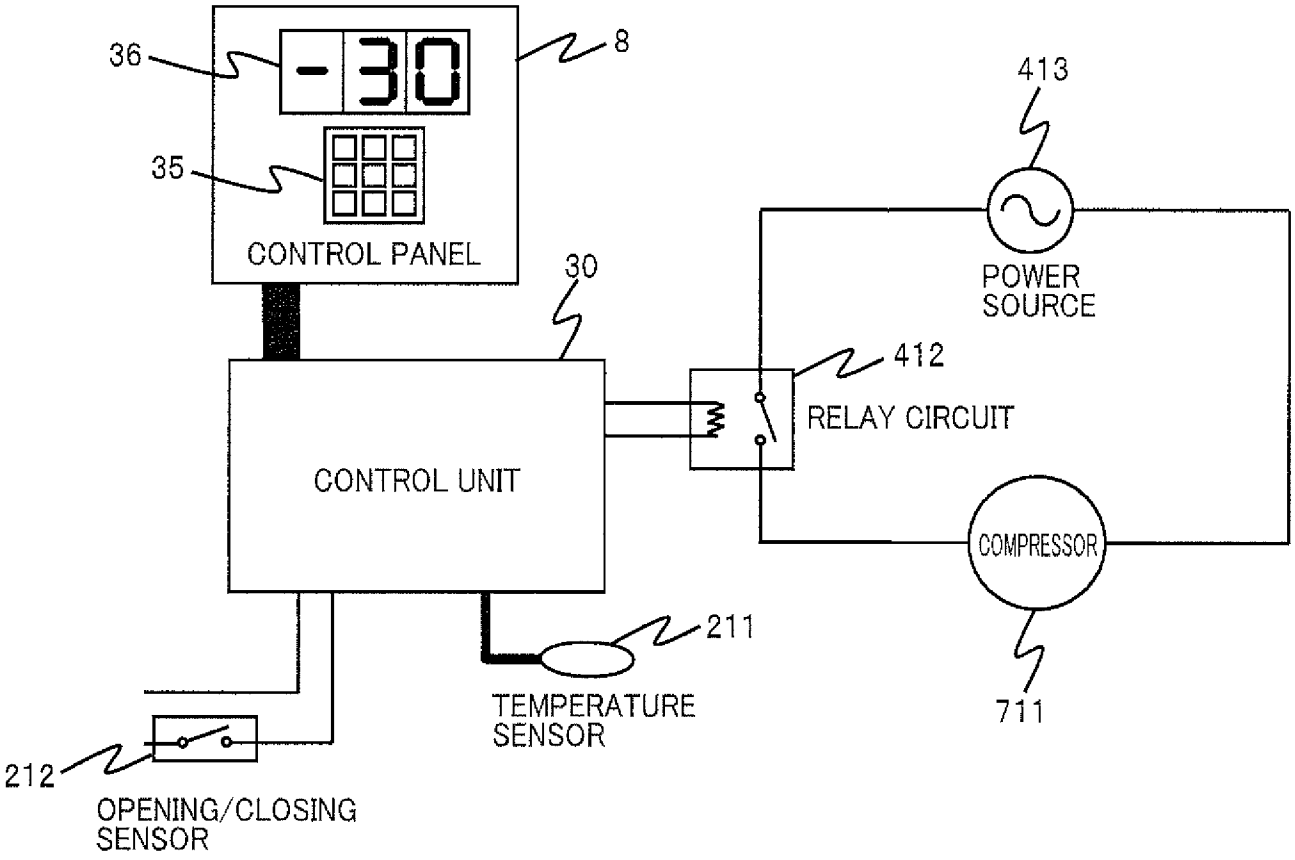
FIG. 3B is a diagram illustrating a configuration example of a control unit 30 using a relay circuit 412.

The control circuit 37 controls the operation of the cooling mechanism 71 in response to the signal from the processor 31. This operational control is performed, for example, by the control circuit 37 controlling the supply of power to the compressor 711 of the cooling mechanism 71 using a relay circuit, an inverter, or the like. A configuration example of the control unit 30 using a relay circuit 412 is illustrated in FIG. 3B.

Figure 4:
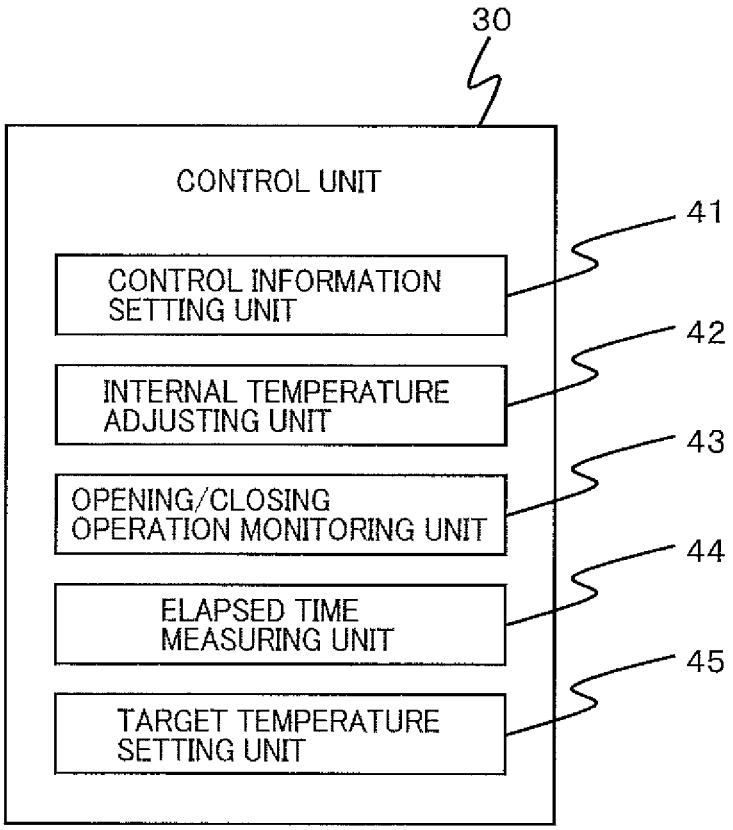
FIG. 4 is a diagram illustrating a function of a control unit 30.

The function of the control unit 30 is illustrated in FIG. 4. As illustrated in the figure, the control unit 30 has the functions of a control information setting unit 41, an internal temperature adjusting unit 42, the opening/closing operation monitoring unit 43, the elapsed time measuring unit 44, and the target temperature setting unit 45. These functions are realized by the hardware included in the control unit 30, or by the processor 31 reading and executing a program stored in the memory 32.

Among the above described functions, the control information setting unit 41 performs interactive processing with a user via the control panel 8, acquires the information (a first temperature, a second temperature (>first temperature), and the switching time) set and inputted by the user, and stores the acquired information in the memory 32.

The internal temperature adjusting unit 42 controls the cooling mechanism 71 through the control circuit 37, and performs adjustment and control so that the temperature of the accommodating portion 21 becomes equal to the predetermined target temperature. The value of the currently set target temperature is stored and held in the memory 32, for example.

The opening/closing operation monitoring unit 43 determines in a real-time whether or not the door 3 has been opened or closed based on a signal inputted from the opening/closing sensor 212. The opening/closing operation monitoring unit 43, for example, is inputted with a signal indicating that the door 3 has been open from the opening/closing sensor 212, and then detects that the open/closed state of the door 3 has changed by being inputted with a signal indicating that the door 3 has been closed from the opening/closing sensor 212, thereby determining the opening/closing of the door 3.

The elapsed time measuring unit 44 measures the elapsed time that is a time period from the time of opening/closing of the door 3 to the current time.

The target temperature setting unit 45 sets the target temperature at a first temperature when the door 3 is opened/closed. Further, the target temperature setting unit 45 automatically switches the setting of the above target temperature at a second temperature when the elapsed time is greater than or equal to a switching time ((current time−time of opening or closing) switching time).

Figure 5:
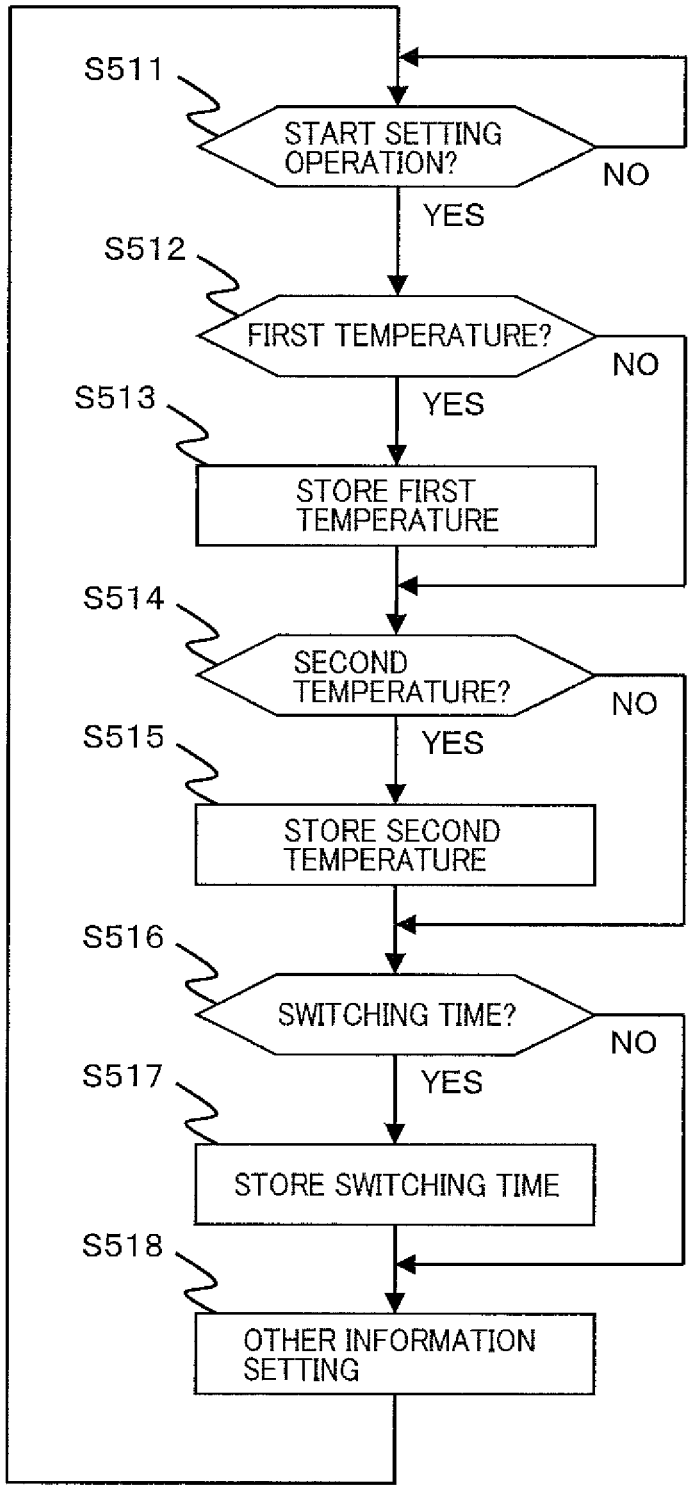
FIG. 5 is a flowchart describing processing performed by a control information setting unit 41 in a control unit 30.

Next, the specific operation of the control unit 30 will be described. FIG. 5 is a flowchart describing the processing executed by the control information setting unit 41 of the control unit 30.

When detecting that a setting operation has been performed (S511: YES), the control information setting unit 41 determines whether or not the executed operation is a setting operation for the first temperature (S512). When the executed operation is a setting operation for the first temperature (S512: YES), the first temperature, which has been set and inputted by a user, is stored in the memory 32 (S513). Thereafter, the processing proceeds to S514. Whereas, when the executed operation is not a setting operation for the first temperature (S512: NO), the processing proceeds to S514.

Then, the control information setting unit 41 determines whether or not the executed operation is a setting operation for the second temperature (S514). When the executed operation is a setting operation for the second temperature (S514: YES), the control information setting unit 41 stores the second temperature, which has been set and inputted by a user, in the memory 32 (S515). Thereafter, the processing proceeds to S516. Whereas, when the executed operation is not a setting operation for the second temperature (S514: NO), the processing proceeds to S516.

Then, the control information setting unit 41 determines whether or not the executed operation is a setting operation for the switching time (S516). When the executed operation is a setting operation for the switching time (S516: YES), the control information setting unit 41 stores the switching time, which has been set and inputted by a user, in the memory 32 (S517). Thereafter, the processing proceeds to S518. On the other hand, when the executed operation is not a setting operation for the switching time (S516: NO), the processing proceeds to S518.

In S518, the control information setting unit 41 executes processing in response to the executed operation (another setting operation other than the above), and after the execution thereof, the processing returns to S511.

Figure 6:
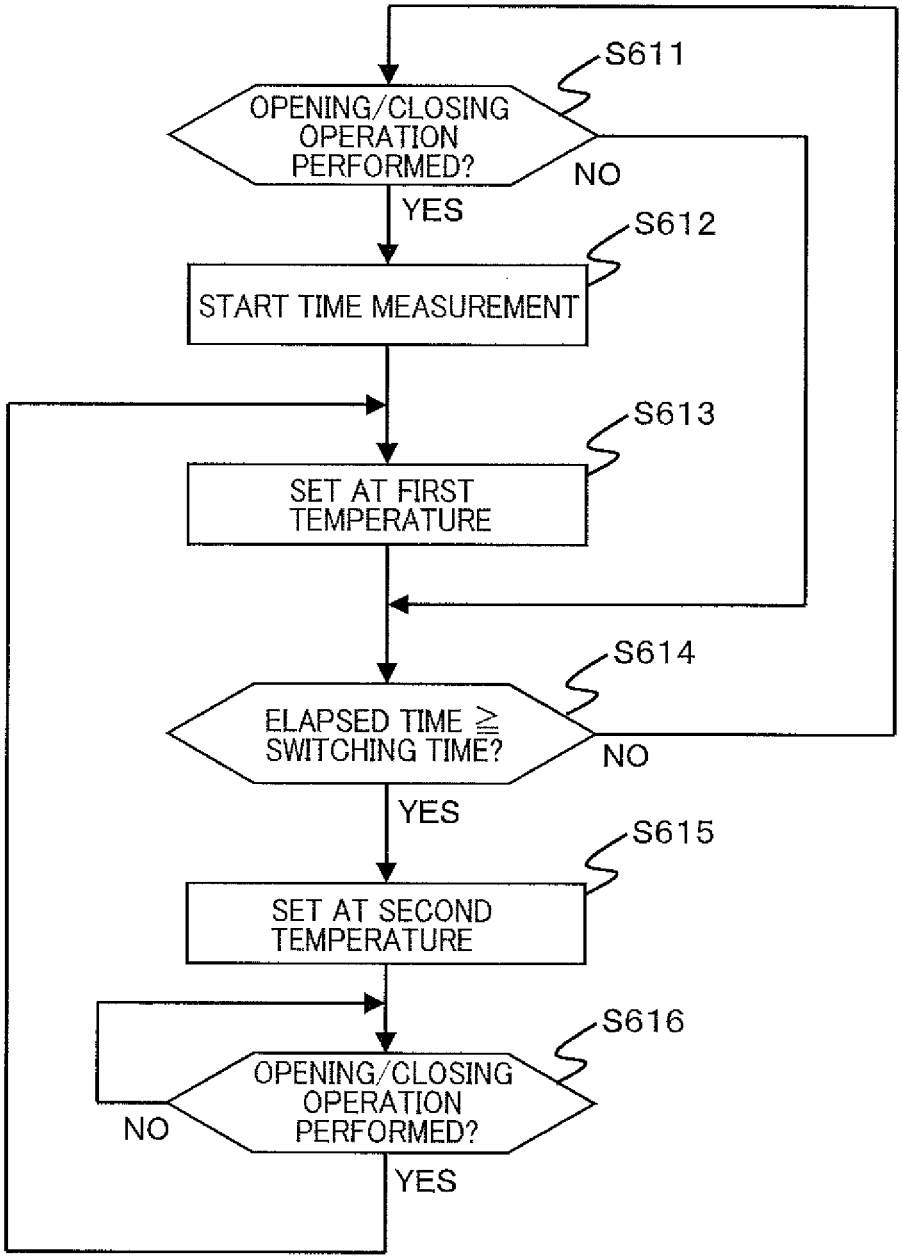
FIG. 6 is a flowchart describing processing performed by an internal temperature adjusting unit 42, an opening/closing operation monitoring unit 43, an elapsed time measuring unit 44, and a target temperature setting unit 45 of a control unit 30 during an operation of a low-temperature storage 1.

FIG. 6 is a flowchart describing the real-time processing performed by the internal temperature adjusting unit 42, the opening/closing operation monitoring unit 43, the elapsed time measuring unit 44, and the target temperature setting unit 45 of the control unit 30 during the operation of the low-temperature storage 1.

The opening/closing operation monitoring unit 43 determines in real-time whether or not the door 3 has been opened or closed based on a signal inputted from the opening/closing sensor 212 (S611). When it is determined that the door 3 has been opened/closed (S611: YES), the processing proceeds to S612.

In S612, the elapsed time measuring unit 44 initiates measurement of the elapsed time. The start time of the measurement of the elapsed time may be a time at which the door 3 has been closed when the door 3 has been opened/closed, or may be a time at which the door 3 has been opened when the door 3 has been opened/closed. Further, it may be any time in a time period from the time at which the door 3 has been opened to the time at which the door 3 has been closed when the door 3 has been opened or closed.

In S613, the target temperature setting unit 45 sets the target temperature at a first temperature. Thereafter, the internal temperature adjusting unit 42 controls the cooling mechanism 71 so that the temperature of the accommodating portion 21 becomes equal to the predetermined target temperature (first temperature).

In S614, the target temperature setting unit 45 determines whether or not the elapsed time is greater than or equal to a switching time ((current time−time of opening or closing) ≥switching time). When the elapsed time is not greater than or equal to the switching time (S614: NO), the processing returns to S611. When the elapsed time is greater than or equal to the switching time (S614: YES), the processing proceeds to S615.

In S615, the target temperature setting unit 45 sets the target temperature at the second temperature (>first temperature). Thereafter, the internal temperature adjusting unit 42 controls the cooling mechanism 71 so that the temperature of the accommodating portion 21 becomes equal to the predetermined target temperature (second temperature).

In S616, the opening/closing operation monitoring unit 43 determines whether or not the door 3 has been opened/closed. When it is determined that the door 3 has been opened/closed (S616: YES), the processing returns to S613.

Figure 7:
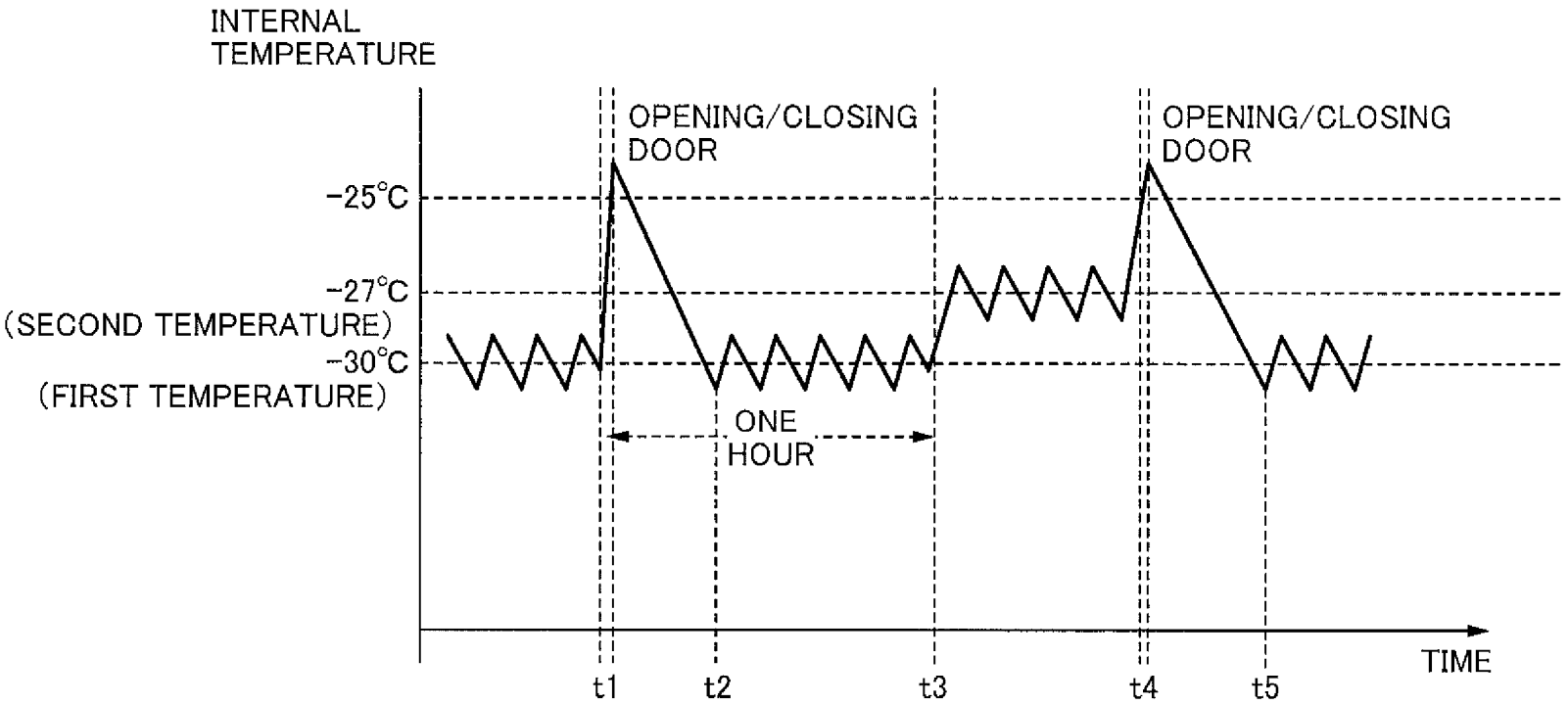
FIG. 7 illustrates an example of temperature change (temperature adjustment) of an accommodating portion 21 when performing processing (control) illustrated in FIG. 6.

FIG. 7 illustrates an example of temperature changes (temperature adjustment) of the accommodating portion 21 when the real-time processing illustrated in FIG. 6 is executed. In the figure, the first temperature is set at −30° C., the second temperature is set at −27° C., which is higher by 3° C. than the first temperature, and the switching time is set at one hour. Since the low-temperature storage 1 is assumed to be a refrigerator in the figure, the first temperature and the second temperature take such values as described above, but when the low-temperature storage 1 is assumed to be an ultra-low temperature freezer, the first temperature is set at −80° C. and the second temperature is set at −77° C., for example.

As illustrated in the figure, during a time period until a time when the door 3 has been opened/closed at a time t1, the accommodating portion 21 is maintained at temperatures near −30° C. When the door 3 has been opened/closed at the time t1, the elapsed time measuring unit 44 starts measuring the elapsed time (processing in S612). The target temperature setting unit 45 set the target temperature at the first temperature (processing in S613).

At a time t3, the target temperature setting unit 45 determines that the elapsed time is greater than or equal to the switching time (=t3−t1) (processing in S614), and sets the target temperature at the second temperature (−27° C.) (processing in S615). At a time t4, the opening the closing operation monitoring unit 43 determines that the door 3 has been opened/closed (processing in S616), and the target temperature setting unit 45 sets the target temperature at the first temperature (processing in S613).

As described above, during the time period between the time t3 and t4 after the time period greater than or equal to the elapsed time has elapsed from the closing of the door 3, the accommodating portion 21 is maintained at a temperature of the second temperature (−27° C.) which is higher by 3° C. than the first temperature (−30° C.). Thus, the low-temperature storage 1 is reduced in power consumption.

Whereas, in the time period until the time t3 and the time period from the time t4 and thereafter in the figure, the accommodating portion 21 is controlled so as to be maintained at a temperature of the first temperature (−30° C.). Thus, even if the door 3 is opened/closed and the temperature of the accommodating portion 21 increases, the temperature of the accommodating portion 21 can be reduced to the required temperature (temperature required for maintaining the preservation quality of an item to be refrigerated) in a short time (=t2−t1, or =t5−t4).

However, for example, if values having a large difference therebetween are set as the first temperature and the second temperature, time is required to return to the first temperature after the door 3 has been opened or closed, thereby not being able to maintain the preservation quality of an item to be refrigerated. Thus, when a user designates values having a large difference therebetween as the first temperature and the second temperature (when the difference therebetween is greater than or equal to a predetermined threshold value), the control information setting unit 41 displays a warning on the display device 36, for example. Alternatively, the user can be notified of a need for caution by beeping from a speaker or the like. Alternatively, when the difference therebetween is greater than or equal to a predetermined threshold value, the control information setting unit 41 may be adapted so as not to accept such setting.

Further, in order to reduce the user's time and effort for setting, for example, a plurality of combinations of the first temperature and the second temperature may be stored in advance in the memory 32 and displayed on the display device 36 to be selected by the user, thereby storing in the memory 32 the first temperature and the second temperature in the selected combination. Further, a plurality of combinations of the first temperature, the second temperature, and the switching time may be stored in the memory 32 and displayed on the display device 36 to be selected by the user, thereby storing the first temperature, the second temperature, and the switching time in the selected combination in the memory 32.

Further, a plurality of combinations of the first temperature and the second temperature, which are set corresponding to items to be refrigerated, based on experiment or experience, may be stored in the memory 32 in such a manner as to be associated with the names (identifiers) of the items to be refrigerated; the names of the items to be refrigerated may be displayed on the display device 36 to be selected by a user; and the first temperature and the second temperature associated with the selected name may be stored in the memory 32. In this manner, a user does not have to look up or remember the combinations of the first temperature and the second temperature corresponding to the items to be refrigerated, and a suitable setting with respect to an item to be refrigerated can be facilitated.

A plurality of combinations of the first temperature, the second temperature, and the switching time, which are set corresponding to items to be refrigerated, based on experiment or experience, may be stored in the memory 32 in such a manner as to be associated with the names (identifier) of the items to be refrigerated; the names of the items to be refrigerated may be displayed on the display device 36 to be selected by a user; and the first temperature, the second temperature, and the switching time associated with the selected name may be stored in the memory 32. In this manner, a user does not have to lookup or remember the combinations of the first temperature, the second temperature, and the switching time corresponding to the items to be refrigerated, and a suitable setting with respect to an item to be refrigerated can be facilitated.

In a low-temperature storage according to an embodiment of the present invention, it is possible to reduce power consumption thereof while maintaining the quality of preservation of an item to be refrigerated.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A low-temperature storage comprising:

a thermally insulated casing including an accommodating portion insulated from external air, the accommodating portion configured to accommodate an item to be refrigerated;

a door provided on the thermally insulated casing, the door configured to be closed in such a manner as to be capable of opening and closing the accommodating portion;

a cooling mechanism that cools an interior of the accommodating portion;

a temperature detecting unit that measures a temperature in the accommodating portion;

an opening and closing detecting unit that detects an open or close state of the door; and a control unit, wherein:

the control unit includes:

a temperature adjusting unit that controls the cooling mechanism so that a temperature measured by the temperature detecting unit becomes equal to a predetermined target temperature;

a first temperature storing unit configured to store a first temperature;

a second temperature storing unit configured to store a second temperature higher than the first temperature;

a target temperature setting unit that sets a target temperature at the first temperature when the opening and closing detecting unit detects that the door has been changed from an open state to closed state, and thereafter, sets the target temperature at the second temperature; and a control information setting unit that sets the first temperature stored in the first temperature storing unit or the second temperature stored in the second temperature storing unit by acquiring information inputted by a user, the information inputted by the user including a user designated first temperature and a user designated second temperature, and the control information setting unit calculates a difference between the user designated first temperature and the user designated second temperature, and when the difference between the user designated first and second temperatures is equal to or greater than a predetermined value when the user inputs the information, at least one operation is performed, the at least one operation being selected from the group consisting of: (i) the control information setting unit outputting information indicating that the difference between the user designated first and second temperatures is equal to or greater than the predetermined value on a display device notifying the user that the information input by the user is not acceptable, (ii) the control information setting unit outputting a beep from a speaker notifying the user that the information input by the user is not acceptable, and (iii) the control information setting unit not accepting the information inputted by a user, thereby notifying the user that the information input by the user is not acceptable.

* * * * *